US012287104B2

(12) United States Patent
Yang et al.

(10) Patent No.: US 12,287,104 B2
(45) Date of Patent: Apr. 29, 2025

(54) MULTI-AREA ARTIFICIAL FOG PIPE NETWORK INTELLIGENT CONTROL METHOD AND SYSTEM BASED ON YOLOv5 ALGORITHM

(71) Applicants: TIANJIN CHENGJIAN UNIVERSITY, Tianjin (CN); XI'AN UNIVERSITY OF ARCHITECTURE AND TECHNOLOGY, Xi'an (CN)

(72) Inventors: Bin Yang, Tianjin (CN); Ruiqi Guo, Tianjin (CN); Xingrui Du, Tianjin (CN); Yuyao Guo, Tianjin (CN); Dacheng Jin, Tianjin (CN); Bingan Pan, Tianjin (CN)

(73) Assignees: Tianjin Chengjian University, Tianjin (CN); Xi'an University of Architecture and Technology, Xi 'an (CN)

( * ) Notice: Subject to any disclaimer, the term of this patent is extended or adjusted under 35 U.S.C. 154(b) by 443 days.

(21) Appl. No.: 17/847,032

(22) Filed: Jun. 22, 2022

(65) Prior Publication Data

US 2023/0083027 A1 Mar. 16, 2023

(30) Foreign Application Priority Data

Sep. 10, 2021 (CN) ..... 2021110644594

(51) Int. Cl.
*F24F 11/64* (2018.01)
*F24F 5/00* (2006.01)
(Continued)

(52) U.S. Cl.
CPC ..... *F24F 11/30* (2018.01); *F24F 5/0035* (2013.01); *F24F 6/12* (2013.01); *F24F 11/64* (2018.01);
(Continued)

(58) Field of Classification Search
None
See application file for complete search history.

(56) References Cited

U.S. PATENT DOCUMENTS 6,467,694 B1 * 10/2002 Jerome ..... F24F 6/14 137/456
2008/0277486 A1 * 11/2008 Seem ..... H04L 67/125 236/49.3

(Continued)

*Primary Examiner* — Jerry-Daryl Fletcher
*Assistant Examiner* — Daniel C Comings
(74) *Attorney, Agent, or Firm* — Hemisphere Law, PLLC; Zhigang Ma

(57) ABSTRACT

A multi-area artificial fog pipe network control method and system based on a you only look once version 5 (YOLOv5) algorithm are provided. The method includes: obtaining thermal sensation data of each target person based on facial skin temperature; calculating group thermal sensation data of each subarea and total group thermal sensation data of an artificial fog pipe network area; determining a total flow of fog-making water introduced into the artificial fog pipe network according to target number of people and total group thermal sensation data; controlling opening gears of atomization nozzles on the artificial fog pipe networks in subareas according to a number of the target person in each subarea, the group thermal sensation data and a micro-action type of each target person.

7 Claims, 4 Drawing Sheets

(51) Int. Cl.

| | |
|---|---|
| ***F24F 6/12*** | (2006.01) |
| ***F24F 11/30*** | (2018.01) |
| *F24F 6/14* | (2006.01) |
| *F24F 110/12* | (2018.01) |
| *F24F 110/22* | (2018.01) |
| *F24F 120/12* | (2018.01) |
| *F24F 120/14* | (2018.01) |

(52) U.S. Cl.
CPC ..... *F24F 6/14* (2013.01); *F24F 2110/12* (2018.01); *F24F 2110/22* (2018.01); *F24F 2120/12* (2018.01); *F24F 2120/14* (2018.01)

(56) References Cited

U.S. PATENT DOCUMENTS

| | | | | |
|---|---|---|---|---|
| 2014/0107846 | A1* | 4/2014 | Li | H04W 4/33 700/275 |
| 2016/0258642 | A1* | 9/2016 | Cheatham, III | G05B 15/02 |
| 2016/0363340 | A1* | 12/2016 | Shikii | F24F 11/74 |
| 2018/0149377 | A1* | 5/2018 | Hale | F24F 6/04 |
| 2021/0140671 | A1* | 5/2021 | Francis | F24F 11/64 |

* cited by examiner

MULTI-AREA ARTIFICIAL FOG PIPE NETWORK INTELLIGENT CONTROL METHOD AND SYSTEM BASED ON YOLOv5 ALGORITHM

TECHNICAL FIELD

The disclosure relates to the field of artificial fog pipe network control technologies, particular to multi-area artificial fog pipe network control method and system based on a YOLOv5 algorithm.

BACKGROUND

In recent years, energy and environmental problems have been increasing rapidly and becoming a major problem that countries need to solve urgently. Energy consumption of buildings accounts for about 40% of world's primary energy requirements. A heating, ventilation, and air conditioning (HVAC) system is a main component of the energy consumption of the buildings, which occupies more than 50% of building energy, so energy saving of the HVAC system of the buildings is very important. In summer, people stay indoors for too long, which leads to huge energy consumption of HVAC system. Studies have shown that people spend about 90% of their time indoors. Indoor air conditioners are run in summer, that requires huge building energy consumption, and if people live in indoor air-conditioned environment for a long time in summer, they will have a greater chance of dizziness, headache, loss of appetite, upper respiratory tract infection and other diseases, which is often referred to as "air conditioning disease". Fundamentally, in most cases, a most important reason why people are reluctant to go out is that the outdoor environment in summer is extremely uncomfortable, so it is very necessary to improve the outdoor environment in summer, so that people are willing to "come out". For this reason, many outdoor public spaces have set up artificial fog systems, which hopes to improve the outdoor environment through the artificial fog systems to cool down, humidify, and remove dust, so that more people can "come out".

The artificial fog system can let people enjoy the atomization cooling effect without affecting their health. However, a traditional artificial fog system mainly depends on an equipment administrator to judge whether the system is turned on, and set the opening interval and running time. This may cause the following problems:

1. Waste of human resources: the current artificial fog system mainly relies on manual operations of the equipment administrator, at least one professional person who understands the thermal environment field is required to manage and operate the equipment, which will bring certain labor costs;
2. Unprofessional administrators: the current artificial fog system is mainly operated manually by the equipment administrator, and the equipment administrator may judge whether to open the artificial fog system according to his own thermal sensation or the thermal sensation of people in the area, which will lead to the actual effect of the artificial fog system is far from the expected effect;
3. The system has no feedback mechanism: the current artificial fog system is only turned on regularly by the administrator, and does not take into account the real thermal sensation and thermal comfort of the people in the area, which may cause the artificial fog system to be turned on and may not achieve the expected cooling effect, and the thermal comfort of the people in the area cannot be improved;
4. Resource and energy waste: when there are few people in public spaces such as scenic spots, urban pedestrian streets, and urban parks, the artificial fog system may continue to operate when there are no people, and a large amount of spray will be produced when there are fewer people, which will cause a huge waste of resources and energy.

SUMMARY

In order to solve the problems in the prior art, the disclosure provides a multi-area artificial fog pipe network control method and a system based on a YOLOv5 algorithm, which solves the problem that the prior art cannot improve the group thermal comfort of outdoor public space in summer in real time.

In order to achieve the above purpose, the disclosure provides the following solution: a multi-area artificial fog pipe network control method based on a YOLOv5 algorithm, includes:

S1, obtaining an air dry bulb temperature $T_{air}$ and an air relative humidity $RH_{air}$ in an artificial fog pipe network area;

S2, obtaining video information in the entire artificial fog pipe network area, and dividing the entire artificial fog pipe network area to obtain N number of subareas; obtaining, in the video information, a total number $X_{total}$ of at least one target person in the entire artificial fog pipe network area, location information of each of the at least one target person and a number $X_i$ of the target person in each of the subareas by using the YOLOv5 algorithm; obtaining, in the video information, a facial skin temperature $t_i$ of each of the at least one target person in the entire artificial fog pipe network area by using a Eulerian video magnification (EVM) algorithm; obtaining, in the video information, a micro-action type Actt of each of the at least one target person in the entire artificial fog pipe network area by using a skeleton node algorithm;

S3, obtaining thermal sensation data $TSV_i$ of each of the at least one target person based on the air dry bulb temperature $T_{air}$, the air relative humidity $RH_{air}$ and the facial skin temperature $t_i$ of each of the at least one target person in the entire artificial fog pipe network area; calculating group thermal sensation data $TSV_{qi}$ of each of the subareas and total group thermal sensation data $TSV_{qtotal}$ of the entire artificial fog pipe network area based on the thermal sensation data $TSV_i$ of each of the at least one target person;

S4, determining a total flow $Q_{total}$ of fog-making water based on the total number $X_{total}$ of the at least one target person in the entire artificial fog pipe network area and the total group thermal sensation data $TSV_{qtotal}$ in the entire artificial fog pipe network area; controlling an opening gear of an atomizing nozzle on an artificial fog pipe network in each of the subareas based on the number $X_i$ of the target person in each of the subareas, the group thermal sensation data $TSV_{qi}$ of each of the subareas, and the micro-action type Actt of the target person in each of the subareas, and spraying the artificial fog pipe network area.

In an embodiment, in the step S1, the air dry bulb temperature $T_{air}$ is compared with a temperature threshold $T_0$, and if the air dry bulb temperature $T_{air}$ is equal to or greater than the temperature threshold $T_0$, the entire artificial fog pipe network area is detected to determine whether there is the target person, and if there is the target person, executing the step S2.

In an embodiment, in the step S2, a total number of best prediction boxes obtained by the YOLOv5 algorithm in the video information is used as the total number $X_{total}$ of the at least one target person; a location of a human face of each of the at least one target person in an original image to be detected obtained by the YOLOv5 algorithm in the video information is used as the location information of each of the at least one target person; each of the subareas to which each of the at least one target person belongs is determined based on a location boundary of each of the subareas and the location information of each of the at least one target person, and thereby the number $X_i$ of the target person in each of the subareas is obtained.

In an embodiment, in the step S2, the micro-action type Actt of the target person includes one selected from an overheating action and an overcooling action, the overheating action includes one of wiping sweat, fanning with hands, shaking clothes and rolling up sleeves; the overcooling action includes one of rubbing hands, exhaling to warm hands and holding hands.

In an embodiment, in the step S3, a calculation formula of the thermal sensation data $TSV_i$ of the target person is that: $TSV_i = a + T_{air} \times K1 + RH_{air} \times K2 + t_i \times K3$;

where $TSV_i$ represents the thermal sensation data of the ith target person; K1, K2, K3 respectively represent linear parameters of a linear regression model; a represents an intercept; and i is a positive integer.

In an embodiment, in the step S3, the group thermal sensation data $TSV_{qi}$ of each of the subareas is calculated based on the thermal sensation data $TSV_i$ of the target person in each of the subareas and the number $X_i$ of the target person in each of the subareas; the total group thermal sensation data $TSV_{qtotal}$ of the entire artificial fog pipe network area is obtained by transforming the thermal sensation data $TSV_i$ of the target person in the entire artificial fog pipe network area and the total number $X_{total}$ of the at least one target person in the entire artificial fog pipe network area;

a calculation formula of the group thermal sensation data $TSV_q$ is that:

$$TSV_q = TSV_1 \times a1 + TSV_2 \times a2 + TSV_3 \times a3 + \ldots + TSV_j \times aj,$$

where $TSV_q$ represents the group thermal sensation data;

$TSV_1$ represents the thermal sensation data of the target person numbered 1;

a1 represents a thermal sensation weight of the target person numbered 1;

$TSV_j$ represents the thermal sensation data of the target person numbered j;

aj represents a thermal sensation weight of the target person numbered j;

note: a1+a2+ . . . +aj=1, and j is a positive integer and if there is no special case, a1=a2= . . . =aj.

In an embodiment, in the step S4, the total flow $Q_{total}$ of the fog-making water introduced into the entire artificial fog pipe network is obtained based on the total number $X_{total}$ of the at least one target person in the artificial fog pipe network area and the total group thermal sensation data $TSV_{qtotal}$ in the artificial fog pipe network area, a calculation formula of the total flow $Q_{total}$ of the fog-making water is that:

$$Q_{total} = X_{total} \times TSV_{qtotal} \times b + e,$$

where b represents a linear regression fitting coefficient; e represents an intercept.

In an embodiment, in step S4, the controlling an opening gear of an atomizing nozzle on an artificial fog pipe network in each of the subareas based on the number of the target person in each of the subareas, the group thermal sensation data of each of the subareas, and the micro-action type of the target person in each of the subareas, includes:

determining the opening gear of the atomizing nozzle on the artificial fog pipe network in each of the subareas based on the number of the target person in each of the subareas; and adjusting the opening gear of the atomizing nozzle on the artificial fog pipe network in each of the subareas based on the group thermal sensation data of each of the subareas and the micro-action type of the target person in each of the subareas;

the opening gear includes first to fourth gears; and the determining the opening gear of the atomizing nozzle on the artificial fog pipe network in each of the subareas based on the number of the target person in each of the subareas, includes:

when the number of the target person in the subarea is equal to or greater than 3, the opening gear of the atomizing nozzle on the artificial fog pipe network in the subarea is the first gear;

when the number of the target person in the subarea is in a range of 3 to 5, the opening degree of the atomizing nozzle on the artificial fog pipe network in the subarea is the second gear;

when the number of the target person in the subarea is in a range of 5 to 10, the opening degree of the atomizing nozzle on the artificial fog pipe network in the subarea is the third gear; and when the number of the target person in the subarea is equal to or greater than 10, the opening degree of the atomizing nozzle on the artificial fog pipe network in the subarea is the fourth gear;

the micro-action type includes one selected from a supercooling action and a superheating action, and the adjusting the opening gear of the atomizing nozzle on the artificial fog pipe network in each of the subareas based on the group thermal sensation data of each of the subareas and the micro-action type of the target person in each of the subareas, includes:

obtaining a target opening gear of the atomizing nozzle on the artificial fog pipe network in each of the subareas by the following steps:

when the group thermal sensation data TSVqi of each of subareas is less than or equal to −2, the opening gear of the atomizing nozzle on the artificial fog pipe network in the subarea is decreased by 1 gear;

when the group thermal sensation data TSVqi of each of the subareas is greater than or equal to 2, the opening gear of the atomizing nozzle on the artificial fog pipe network in the subarea is increased by 1 gear;

when the supercooling action is detected in the subarea, the opening gear of the atomizing nozzle in this subarea is decreased by 1 gear; and when the superheating action is detected in the subarea, the opening gear of the atomizing nozzle in this subarea is increased by 1 gear;

if the target opening degree is lower than or equal to 0, the atomizing nozzle on the artificial fog pipe network is closed; if the target opening degree is greater than 4, the target opening degree is the fourth gear.

The disclosure further provides a multi-area artificial fog pipe network control system based on the YOLOv5 algorithm, including an electronic thermostat system, a human body monitoring system, a video monitoring and vision system, and a central control system. Compared with the prior art, the disclosure at least has the following beneficial effects:

the disclosure provides the multi-area artificial fog pipe network control method and the system based on the YOLOv5 algorithm, by obtaining the air dry bulb temperature $T_{air}$ of external environment in real time, judging whether there is the target person in the artificial fog pipe network area, and detecting the number of the target person within a recognizable range in real time, controlling the flow of fog produced by the artificial fog system and the opening gear of the atomizing nozzle on the artificial fog pipe network in each subarea through the number of the target person in the subarea, the thermal sensation data of the target person and the micro-action type of the target person, therefore, the purposes of saving energy, reducing emission, accurately controlling the flow of the fog-making water, and the people-oriented aim and outdoor group heat comfort maximization can be achieved.

The disclosure initially judges the air dry bulb temperature $T_{air}$ of the external environment, and when the air dry bulb temperature $T_{air}$ of the external environment does not reach the set threshold, the subsequent steps do not need to be performed; the disclosure further detects whether there is the target person in the artificial fog pipe network area, if there is no the target person, the subsequent steps do not need to be performed. The disclosure judges whether the subsequent steps are performed through a two-layer judgment mechanism, thereby the meaningless work times and time of the subsequent steps can be reduced.

The disclosure obtains the number of the target person in the artificial fog pipe network area, the location information of the target person, the facial skin temperature of the target person and the micro-action type of the target person by using the YOLOv5 algorithm, the Eulerian video magnification algorithm, and the skeleton recognition algorithm; and through the above data, the total flow of the fog-making water of the artificial fog system and the opening gear of the atomizing nozzle are controlled, so as to avoid the problems of creating a large number of fog when people are small and creating fog when there are no people, so as to achieve the purpose of saving resources.

The system of the disclosure sends the collected skin temperature, the predicted thermal sensation data and the acceptability of the regulated terminal equipment parameters to the central control system, which can take real-time control of the artificial fog system and quickly improve the environment in the area in a very short time; the system of the disclosure adopts computer automation and intelligent control, and the equipment administrator does not need to detect the use environment of the artificial fog system on the spot to judge whether the artificial fog system needs to be started, but only needs to regularly check and update the system of the disclosure, so as to reduce the waste of human resources and increase the labor productivity.

The system of the disclosure includes the data storage system, the anthropomorphic learning system and the thermal environment feedback system, a large number of system operation data and personnel thermal environment feedback data are collected, the parameters of the linear regression integrated learning model in the thermal sensation predictor are continuously trained and optimized through the anthropomorphic learning system, the accuracy of the whole system can be improved, and the opening gear of the atomizing nozzle can be accurately controlled, so as to improve the thermal comfort of the people, and thus meet the best thermal comfort of the human body.

DETAILED DESCRIPTION OF THE EMBODIMENTS

The disclosure will be further described below with reference to the accompanying drawings and specific embodiments.

Figure 1:
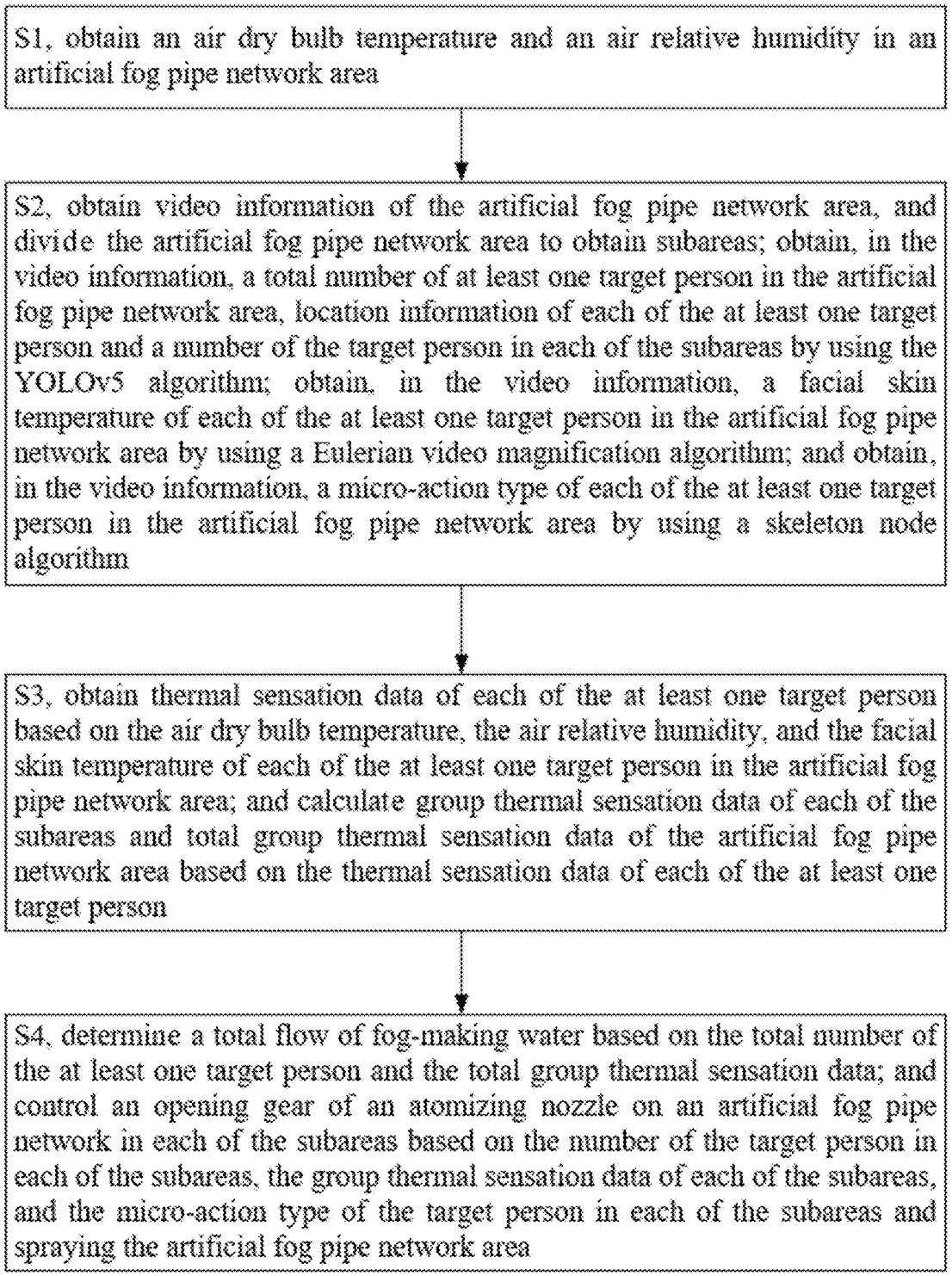
FIG. 1 illustrates a schematic flowchart of a multi-area artificial fog pipe network control method based on a YOLOv5 algorithm.
Figure 2:
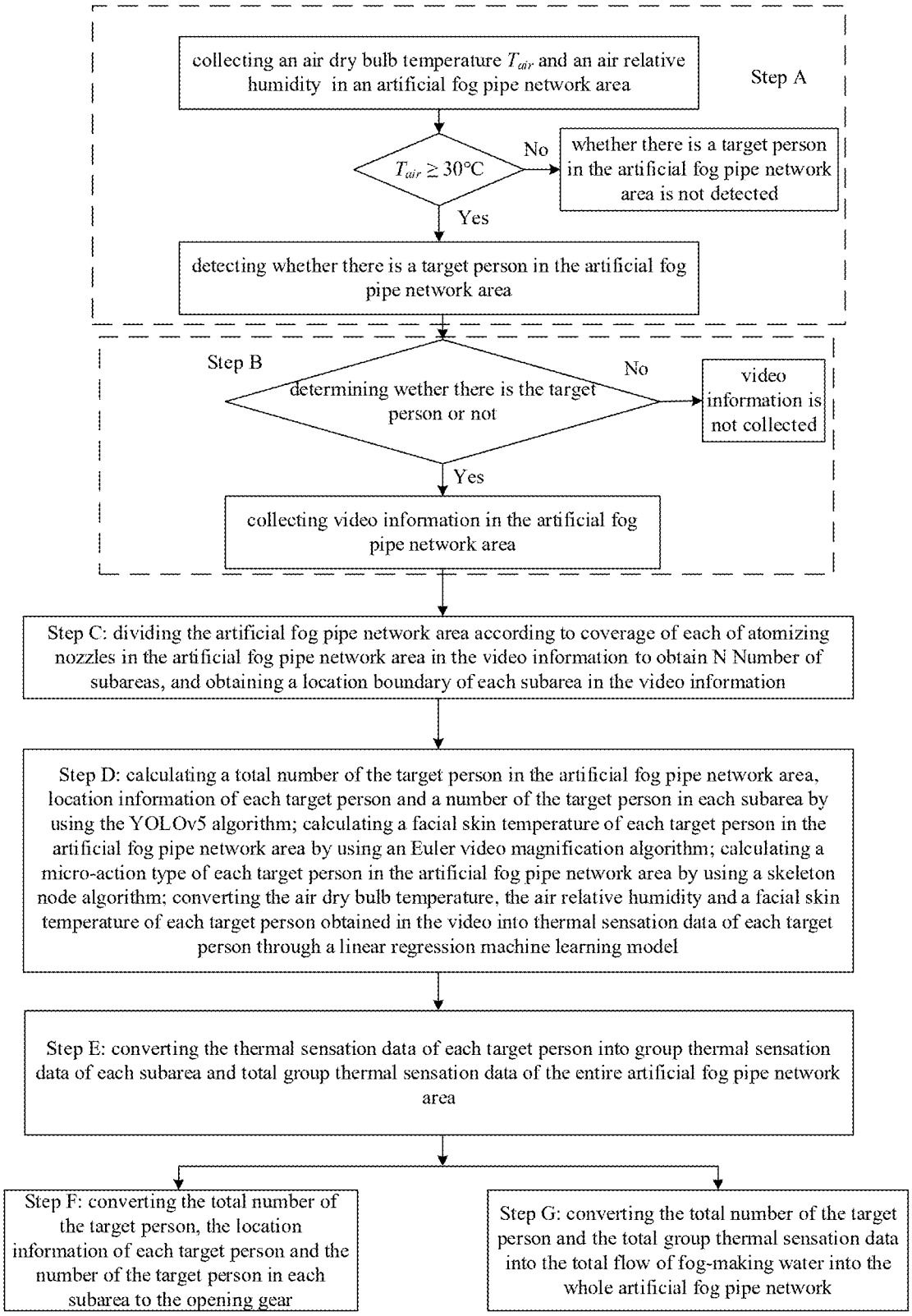
FIG. 2 illustrates a specific schematic flowchart of the multi-area artificial fog pipe network control method based on the YOLOv5 algorithm.
Figure 3:
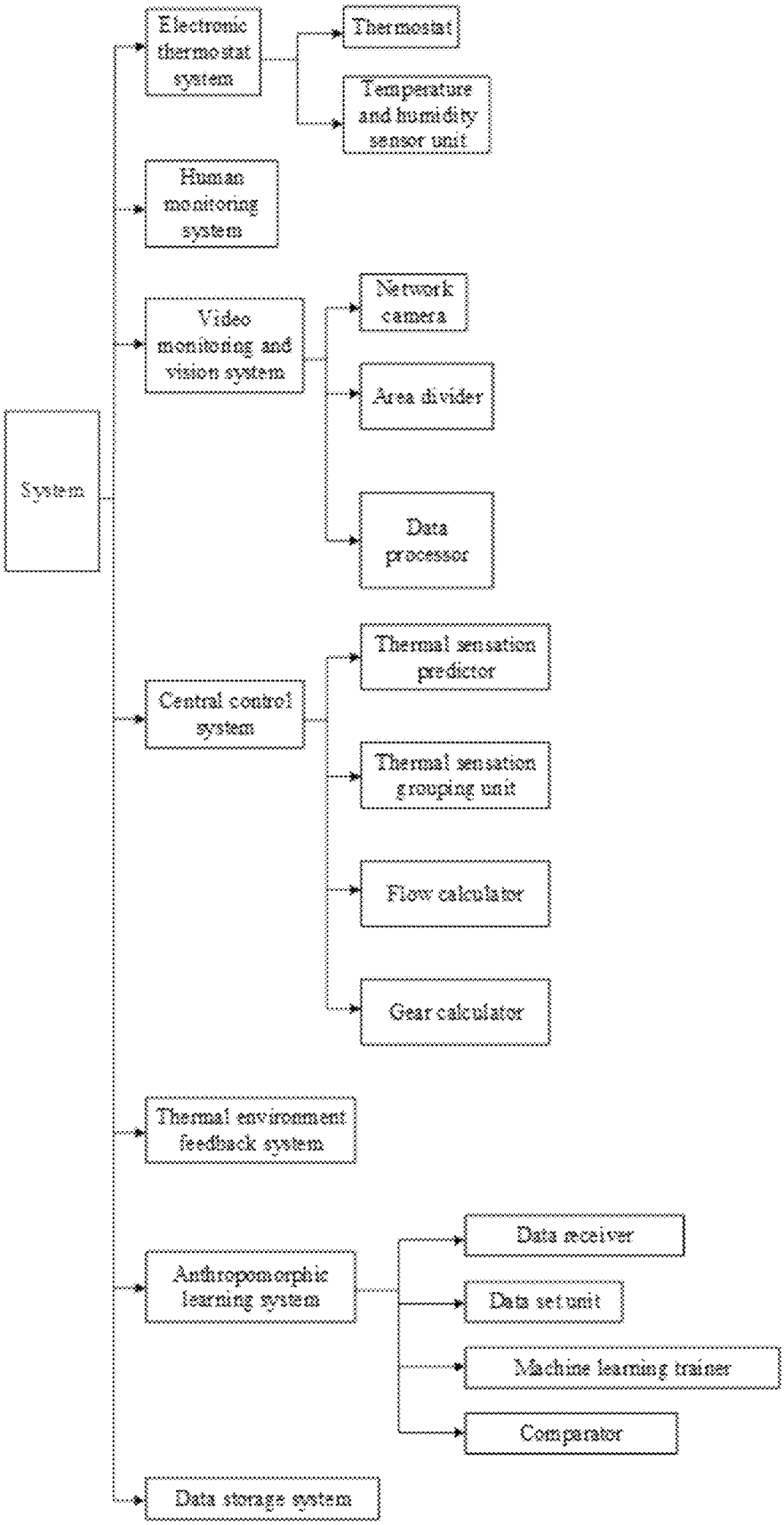
FIG. 3 illustrates a schematic structural view of a multi-area artificial fog pipe network control system based on a YOLOv5 algorithm.
Figure 4:
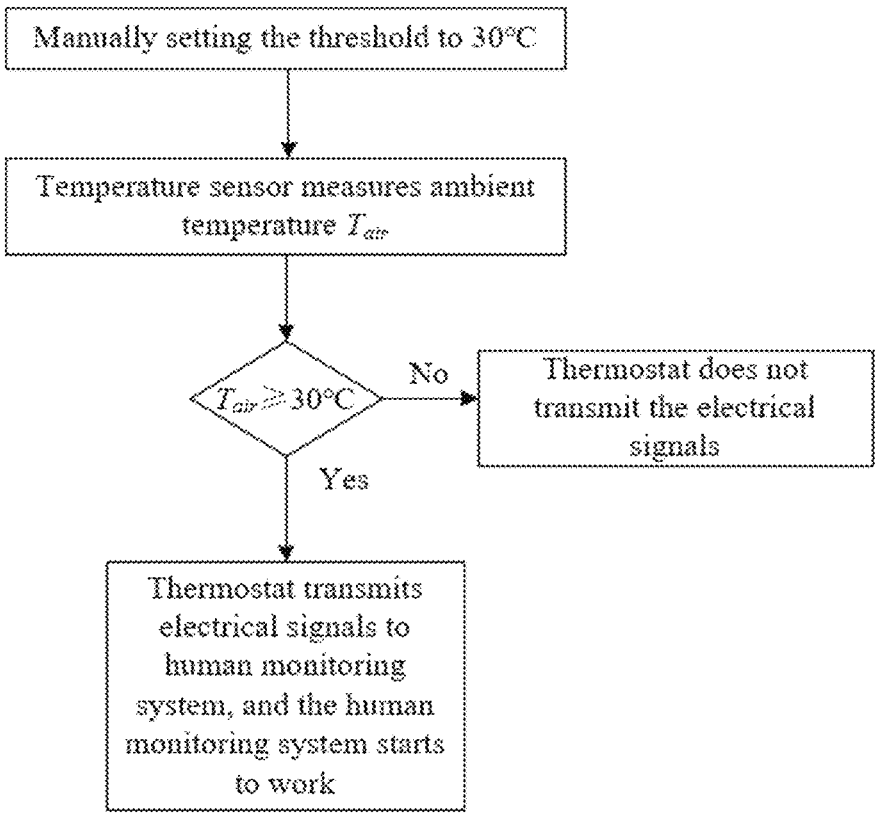
FIG. 4 is a schematic flowchart of work of an electronic thermostat system.

As shown in FIG. 1, the disclosure provides a multi-area artificial fog pipe network control method based on a YOLOv5 algorithm, including the steps S1 to S4. Further, as shown in FIG. 2, the multi-area artificial fog pipe network control method specifically includes step A to step G as follows.

At the step A, an air dry bulb temperature $T_{air}$ and an air relative humidity $RH_{air}$ in an artificial fog pipe network area are collected, if the air dry bulb temperature $T_{air}$ is equal to or greater than a temperature threshold $T_0$, whether there is a target person in the entire artificial fog pipe network area is detected; if the air dry bulb temperature $T_{air}$ is lower than the temperature threshold $T_0$, whether there is the target person in the area is detected.

At the step B, if there is the target person in the entire artificial fog pipe network area, video information in the entire artificial fog pipe network area is collected to obtain the video information.

At the step C, the artificial fog pipe network area is divided based on a coverage of each of atomizing nozzles in the artificial fog pipe network area in the video information to obtain N number of subareas, and a location boundary of each of the subareas in the video information is obtained.

At the step D, a total number $X_{total}$ of the target person in the entire artificial fog pipe network area, location information of each target person and a number $X_i$ of the target person in each of the subareas are calculated by using the YOLOv5 algorithm;

a facial skin temperature $t_i$ of each target person in the entire artificial fog pipe network area is calculated by using a Eulerian video magnification algorithm; and a micro-action type Actt of each target person in the entire artificial fog pipe network area is calculated by using a skeleton node algorithm.

Specifically, skin color saturation is obtained by Fourier transform through the Eulerian video magnification algorithm. Because there is a linear relationship between the skin color saturation and the skin temperature, the facial skin temperature $t_i$ of the target person can be obtained.

Specifically, the skeleton node algorithm is an OpenPose algorithm.

In an illustrated embodiment, the micro-action type Actt of each target person includes one selected from an overheating action and an overcooling action, and a spray flow can be automatically adjusted through the micro-action type Actt according to the skeleton node algorithm.

Specifically, the overheating action includes wiping sweat, fanning with hands, shaking clothes, rolling up sleeves, etc. The overcooling action includes rubbing hands, exhaling to warm hands, holding hands, etc.

At the step D, the air dry bulb temperature $T_{air}$, the air relative humidity $RH_{air}$ and the facial skin temperature $t_i$ of each target person obtained in the video are converted into thermal sensation data $TSV_i$ of each target person through a linear regression machine learning model, and a calculation formula of the thermal sensation data $TSV_i$ is that: $TSV_i=a+T_{air}\times K1+RH_{air}\times K2+t_i\times K3$.

Where $TSV_i$ represents the thermal sensation data of the ith target person; K1, K2, K3 respectively represent linear parameters of the linear regression machine learning model (i.e., linear regression model); a represents an intercept, and i is a positive integer.

Specifically, a standard of the thermal sensation data TSV is determined as a 7-point system according to the specification ASHRAE Standard 55-2020 formulated by ASHRAE (American Society of Heating, Refrigerating and Air-Conditioning Engineers), and the specific divisions are shown in Table 1.

TABLE 1

| Thermal sensation scale | | | | | | | |
|---|---|---|---|---|---|---|---|
| Thermal sensation | cold | cool | slightly cool | neutral | slightly warm | warm | hot |
| Thermal sensation data TSV | −3 | −2 | −1 | 0 | 1 | 2 | 3 |

At the step E, the thermal sensation data $TSV_i$ of each target person is converted into group thermal sensation data $TSV_{qi}$ of each subarea and total group thermal sensation data $TSV_{qtotal}$ of the entire artificial fog pipe network area. A calculation formula of the group thermal sensation data is that:

$$TSV_q=TSV_1\times a1+TSV_2\times a2+TSV_3\times a3+\ldots+TSV_j\times aj.$$

Where $TSV_q$ represents the group thermal sensation data;

$TSV_1$ represents the thermal sensation data of the target person numbered 1;

a1 represents a thermal sensation weight of the target person numbered 1;

TSV; represents the thermal sensation data of the target person numbered j;

aj represents a thermal sensation weight of the target person numbered j.

Note: a1+a2+ . . . +aj=1, j is a positive integer, and if there is no special case, a1=a2= . . . =aj.

In an illustrated embodiment, the group thermal sensation data $TSV_{qi}$ of each subarea is transformed from the thermal sensation data $TSV_i$ of the target person in each subarea; the total group thermal sensation data $TSV_{qtotal}$ of the entire artificial fog pipe network area is transformed from the thermal sensation data $TSV_i$ of each target person in the artificial fog pipe network entire area.

At the step F, the total number $X_{total}$ of the target person in the artificial fog pipe network area and the total group thermal sensation data $TSV_{qtotal}$ in the entire artificial fog pipe network area are converted into the total flow $Q_{total}$ of fog-making water passing into the entire artificial fog pipe network, and a calculation formula of the total flow $Q_{total}$ of fog-making water is as follows:

$$Q_{total}=X_{total}\times TSV_{qtotal}\times b+e.$$

Where b represents a linear regression fitting coefficient; and e represents an intercept.

At the step G, the number $X_i$ of the target person in each subarea is converted into the opening gear of the atomizing nozzle on an artificial fog pipe network in each subarea through a gear calculation algorithm, and the opening gear of the atomizing nozzle is adjusted based on the group thermal sensation data $TSV_{qi}$ of each subarea and the micro-action type Actt of the target person in each subarea, and the artificial fog pipe network area is sprayed. Specifically, the gear calculation algorithm is as follows:

when there are 3 numbers of the target persons or less in the subarea, the opening gear of the atomizing nozzle on the artificial fog pipe network in this subarea is a first gear;

when there are 3 to 5 numbers of the target persons in the subarea, the opening degree of the atomizing nozzle on the artificial fog pipe network in this subarea is a second gear;

when there are 5 to 10 numbers of the target persons in the subarea, the opening degree of the atomizing nozzle on the artificial fog pipe network in this subarea is a third gear; and when there are 10 numbers of the target persons or more in the subarea, the opening degree of the atomizing nozzle on the artificial fog pipe network in this subarea is a fourth gear.

Note: 1. the opening degree includes the first to the fourth gears, the higher the gear, the greater the opening of a valve;

2. when the group thermal sensation data $TSV_{qi}$ of each subarea is less than or equal to −2, the opening gear of the atomizing nozzle on the artificial fog pipe network in this subarea is decreased by 1 gear; when the group thermal sensation data TSV gi of each subarea is greater than or equal to 2, and the opening gear of the atomizing nozzle on the artificial fog pipe network in this subarea is increased by 1 gear;

3. when the supercooling action is detected in the subarea, the opening gear of the atomizing nozzle in this subarea is decreased by 1 gear; when the superheating action is detected in the subarea, the opening gear of the atomizing nozzle in this subarea is increased by 1 gear;

4. the opening gear of the valve is calculated by the gear calculation algorithm, and then the opening gear of the valve is adjusted by the group thermal sensation data of each subarea and the micro-action type of the target person. The final opening gear (i.e., target opening gear) is calculated as the direct accumulation of the above three adjustment methods of the opening gear.

5. if the final opening gear is lower than or equal to 0, the atomizing nozzle on the artificial fog pipe network in this subarea is closed; and if the final opening gear is greater than 4, the opening gear of the atomizing nozzle on the artificial fog pipe network in this subarea is the fourth gear.

As shown in FIG. 1 to FIG. 4, the disclosure discloses a multi-area artificial fog pipe network control system based on a YOLOv5 algorithm, including: an electronic thermostat system, a human monitoring system, a video monitoring and visual system, a central control system, a data storage system, an anthropomorphic learning system, and a thermal environment feedback system.

The electronic thermostat system, the human monitoring system, the video monitoring and vision system can continuously collect data in real time and the obtained data is relatively stable.

1, The electronic thermostat system includes a temperature and humidity sensor unit and a thermostat. The thermostat is configured to obtain an air dry bulb temperature $T_{air}$ of outside environment, and compare the air dry bulb temperature $T_{air}$ with a temperature threshold $T_0$ to control whether to turn on the human monitoring system.

The temperature and humidity sensor unit may include a humidity sensor and a temperature sensor such as a T-type thermocouple thermometer, and a temperature measurement range of the T-type thermocouple thermometer is in a range of −20° C. to +60° C. The electronic thermostat system work mainly includes the following steps: the temperature and humidity sensor unit measures that the air dry bulb temperature $T_{air}$ is t1, the ambient temperature threshold $T_0$ is set to 30° C., and the thermostat compares the air dry bulb temperature t1 with the set ambient temperature threshold 30° C., when t1 is greater than or equal to 30° C., the thermostat transmits electrical signals to the human monitoring system, and the human monitoring system starts to work; or when t1 is less than 30° C., the thermostat does not transmit the electrical signals.

2, the Human Monitoring System

The human monitoring system is configured to receive the electrical signals transmitted by the electronic thermostat system, and detect whether there is the target person in an area of an artificial fog pipe network. If there is the target person in the area, the human monitoring system transmits the electrical signals to the video monitoring and vision system; or if there is no the target person, no electrical signals are transmitted.

3, the Video Monitoring and Vision System Includes a Network Camera, an Area Divider, and a Data Processor.

The network camera is configured to receive the electrical signals transmitted by the human monitoring system, and record video of the area to obtain video information.

In an illustrated embodiment, the network camera includes a transmission unit, a memory, a processer, and a computer Python program stored in the memory and executable by the processer; the processer is configured, when executing the computer program, to complete any one of the target detection technology, Eulerian video magnification technology and skeleton node technology of the system described in any one of the embodiments by using a PYtorch framework.

The area divider is configured to divide the artificial fog pipe network area in the video information into N number of subareas according to the coverage of each of the atomizing nozzles of the artificial fog pipe network, and obtains a location boundary of each of the subareas in the video information.

The data processer includes a target detector, a skeleton node recognition unit and a Eulerian video magnification unit.

The target detector is configured to obtain the total number $X_{total}$ of the target person in the entire artificial fog pipe network area, location information of each target person and the number $X_i$ of the target person in each subarea through the YOLOv5 algorithm model.

The skeleton node recognition unit is configured to obtain the posture and action of human body through the OpenPose algorithm, make a preliminary judgment on a thermal comfort of the human body, and obtain the micro-action type Actt of each target person in the entire artificial fog pipe network area.

The Eulerian video magnification unit is configured to perform Fourier transformation through the Eulerian video magnification algorithm to obtain the skin color saturation. Since the skin color saturation has a linear relationship with the skin temperature, the facial skin temperature $t_i$ of each target person in the entire artificial fog pipe network area can be obtained.

The video monitoring and vision system is configured to upload the obtained video information, the total number $X_{total}$ of the target person, the facial skin temperature $t_i$ of each target person, and the micro-action type Actt of each target person to the central processing system in real time.

In an illustrated embodiment:

3.1 the Skeleton Node Recognition Unit

The skeleton node recognition unit is configured to adopt the skeleton node recognition technology to detect the human skeleton nodes in the video information, obtain the human skeleton node information, and recognize the micro-action type Actt of each target person in the video information;

3.2 the Eulerian Video Magnification Unit

The Eulerian video magnification unit is configured to use Eulerian video magnification technology to capture subtle changes in the face of each target person, and record the change amplitude and frequency. The Eulerian video magnification unit can capture the contraction changes of facial capillaries and nose breathing. It uses the linear Eulerian video magnification algorithm to calculate the face temperature, and uses Fourier series transformation to obtain skin color saturation. According to the linear relationship between the skin color saturation and the skin temperature, the facial skin temperature $t_i$ of each target person in the whole artificial fog pipe network area can be obtained.

3.3 the Target Detector

The target detector adopts a YOLOv5 model. Model sizes of different versions of YOLOv5 (You Only Look Once Version 5) are: YOLOv5x with a size of 367 MB, YOLOv5l with a size of 192 MB, YOLOv5m with a size of 84 MB, and YOLOv5s with a size of 27 MB. Although both YOLOv5m and YOLOv5s are relatively small in model size, the accuracy is relatively low. Therefore, without sacrificing too much recognition accuracy, the deployment cost is reduced, and the YOLOv5l version is selected, which is conducive to the rapid deployment of the model and the accuracy is guaranteed.

3.3.1 Predicting the Total Number of the Target Person and the Location Information of Each Target Person Based on a YOLOv5 Target Detection Model.

The YOLOv5 target detection model includes GoogleNet+4 convolutions and 2 fully connected layers.

1) Taking a frame of the video information every 5 seconds as image sample data, preprocessing the obtained image sample data of each frame, resetting the image resolution according to input requirements of the YOLOv5 target detection model, and normalizing image pixel values to obtain image feature data.
2) Inputting the image feature data into the preprocessed YOLOv5 target detection model to obtain best prediction boxes.

Specifically, the model resizes the image feature data into 448×448 format, and outputs a 7×7×30 grid after passing the image feature data through the convolutional network; each grid predicts 5 numbers of boxes; the improved Non-maximum suppression algorithm (NMS) is used to screen and intersection and union (IoU) is used judge to obtain the best prediction boxes, and a total number of the best prediction boxes is calculated as the total number $X_{total}$ of the target person in the entire artificial fog pipe network area.

3) Obtaining the best prediction boxes of the image feature data, performing inverse processing on the image feature data with a specific structure, restoring a structure of an original image to be detected, obtaining a location of the human face in the original image to be detected to as the location information of the target person, and using the location information of the target person to mark the image feature data obtained in the step 1) to generate a training sample set.

In an illustrated embodiment, marking is performed on the video information by using an image annotation software labeling.

In an illustrated embodiment, the best prediction boxes of the human face in the image to be detected in the current frame is selected from the plurality of prediction boxes according to a preset rule, and the location of the human face in the image to be detected in the current frame is obtained according to the best prediction boxes.

3.3.2 the YOLOv5 Target Detection Model is Updated Based on the Training Sample Set.

Inputting each training image feature data in the training sample set obtained in the step 3) to the YOLOv5 target detection model to be trained for training, and updating parameters of the YOLOv5 target detection model after training.

3.3.3 Uploading Calculation Results to the Central Processing System.

The number of the best prediction boxes output by the YOLOv5 model is taken as the target number $X_{total}$ and output to the central control system. Each subarea to which each target person belongs is judged according to the location information of the target person and the location boundary of each subarea in the camera captured image. The number $X_i$ of the target person in each subarea is calculated and output to the central control system.

4, the Central Control System Includes a Thermal Sensation Predictor, a Thermal Sensation Grouping Unit, a Flow Calculator, and a Gear Calculator.

The central control system is configured to control the opening gear of the atomizing nozzle in the artificial fog system and adjust the flow value of spray in the artificial fog system during this period; the number of the target person in the artificial fog system area is used to determine the valve opening data of the solenoid valve of the atomizing nozzle in each subarea. The central control system controls the opening gear of the atomizing nozzle in different subareas to control the artificial fog flow in different subareas according to the number of the target person in different subareas.

The thermal sensation predictor is configured to convert the air dry bulb temperature $T_{air}$ and air relative humidity $RH_{air}$ obtained by the electronic thermostat system, as well as the facial skin temperature $t_i$ of each target person detected by the video monitoring and vision system in the whole artificial fog pipe network area into the thermal sensation data $TSV_i$ of each target person.

The thermal sensation grouping unit is configured to convert the thermal sensation data $TSV_i$ of each target person into the group thermal sensation data $TSV_{qi}$ of each subarea and the total group thermal sensation data $TSV_{qtotal}$ of the entire artificial fog pipe network area.

The flow calculator is configured to convert the total number $X_{total}$ of the target person and the group thermal sensation data $TSV_{qtotal}$ of the entire artificial fog pipe network area into the total flow $Q_{total}$ of fog-making water flowing into the entire artificial fog pipe network.

The gear calculator is configured to convert the number $X_i$ of the target person in each subarea and the group thermal sensation data $TSV_{qi}$ in each subarea into the opening data of the solenoid valve of the atomizing nozzle in different subareas of the artificial fog pipe network through the gear calculation algorithm, and thereby to adjust the opening gear of the atomizing nozzle.

5, the Thermal Environment Feedback System

The thermal environment feedback system is configured to collect a thermal environment subjective questionnaire of each target person in the entire artificial fog area by scanning the two-dimensional codes through the questionnaire feedback unit. When 100 numbers of the thermal environment subjective questionnaires are collected, the thermal environment data is transmitted to the anthropomorphic learning system.

6, the Anthropomorphic Learning System

The anthropomorphic learning system includes a data receiver, a data set unit, a machine learning trainer, and a comparator.

The data receiver is configured to receive the thermal environment data of the thermal environment feedback system. The data set unit is configured to randomly divide the thermal environment data into 70% training set and 30% test set. The machine learning trainer is configured to extract the data in the data set unit for training the linear regression integrated learning model in the thermal sensation predictor. The comparator is configured to compare the precision and recall rate of the updated machine learning model after training and the machine learning model before training. If the precision of the machine learning model after training is large, the comparator can update the linear regression integrated learning model in the thermal sensation predictor.

7, the Data Storage System

The data storage system may include a data receiver, a memory, a data uploader and a data transmitter.

The data receiver is configured to receive the data transmitted from other systems, and then transmit the data to the memory. The memory is configured to store the data. The data uploader is configured to upload the data in the memory to the cloud network disk once every 1 hour. The data transmitter is configured to selectively transmit data to the other systems.

What is claimed is:

1. A multi-area artificial fog pipe network control method based on a you only look once version 5 (YOLOv5) algorithm, comprising:

S1, obtaining an air dry bulb temperature and an air relative humidity in an artificial fog pipe network area;

S2, obtaining video information of the artificial fog pipe network area, and dividing the artificial fog pipe network area to obtain subareas; obtaining, in the video information, a total number of at least one target person in the artificial fog pipe network area, location information of each of the at least one target person and a number of the target person in each of the subareas by using the YOLOv5 algorithm; obtaining, in the video information, a facial skin temperature of each of the at least one target person in the artificial fog pipe network area by using a Eulerian video magnification algorithm; and obtaining, in the video information, a micro-action type of each of the at least one target person in the artificial fog pipe network area by using a skeleton node algorithm;

S3, obtaining thermal sensation data of each of the at least one target person based on the air dry bulb temperature, the air relative humidity, and the facial skin temperature of each of the at least one target person in the artificial fog pipe network area; and calculating group thermal sensation data of each of the subareas and total group thermal sensation data of the artificial fog pipe network area based on the thermal sensation data of each of the at least one target person; and S4, determining a total flow of fog-making water based on the total number of the at least one target person and the total group thermal sensation data; and controlling an opening gear of an atomizing nozzle on an artificial fog pipe network in each of the subareas based on the number of the target person in each of the subareas, the group thermal sensation data of each of the subareas, and the micro-action type of the target person in each of the subareas and spraying the artificial fog pipe network area.

2. The multi-area artificial fog pipe network control method based on the YOLOv5 algorithm according to claim 1, wherein the step S1 further comprises:

comparing the air dry bulb temperature with a temperature threshold;

determining whether there is the target person in the artificial fog pipe network area, in response to the air dry bulb temperature being equal to or greater than the temperature threshold; and executing the step S2 in response to there being the target person.

3. The multi-area artificial fog pipe network control method based on the YOLOv5 algorithm according to claim 1, wherein the obtaining, in the video information, a total number of at least one target person in the artificial fog pipe network area, location information of each of the at least one target person and a number of the target person in each of the subareas by using the YOLOv5 algorithm, comprises:

obtaining a total number of best prediction boxes in the video information by using the YOLOv5 algorithm to as the total number of the at least one target person;

obtaining, in the video information, a location of a human face of each of the at least one target person in an original image to be detected to as the location information of each of the at least one target person by using the YOLOv5 algorithm;

determining each of the subareas to which each of the at least one target person belongs based on a location boundary of each of the subareas and the location information of each of the at least one target person, and thereby obtaining the number of the target person in each of the subareas.

4. The multi-area artificial fog pipe network control method based on the YOLOv5 algorithm according to claim 1, wherein the micro-action type comprises: one selected from an overheating action and an overcooling action, the overheating action comprises one of wiping sweat, fanning with hands, shaking clothes and rolling up sleeves, and the overcooling action comprises one of rubbing hands, exhaling to warm hands, and holding hands.

5. The multi-area artificial fog pipe network control method based on the YOLOv5 algorithm according to claim 1, wherein a calculation formula of the thermal sensation data is that: $TSV_i=a+T_{air}\times K1+RH_{air}\times K2+t_i\times K3$;

where $TSV_i$ represents the thermal sensation data of the ith target person, K1, K2, K3 respectively represent linear parameters of a linear regression model, a represents an intercept, $T_{air}$ represents the air dry bulb temperature, $RH_{air}$ represents the air relative humidity, $t_i$ represents the facial skin temperature of the ith target person, and i is a positive integer.

6. The multi-area artificial fog pipe network control method based on the YOLOv5 algorithm according to claim 1, wherein the calculating group thermal sensation data of each of the subareas and total group thermal sensation data of the artificial fog pipe network area based on the thermal sensation data of each of the at least one target person, comprises:

calculating the group thermal sensation data of each of the subareas based on the thermal sensation data of the target person in each of the subareas and the number of the target person in each of the subareas; and calculating the total group thermal sensation data of the artificial fog pipe network area based on the thermal sensation data of each of the at least one target person in the artificial fog pipe network area and the total number of the at least one target person in the artificial fog pipe network area;

wherein a calculation formula of the group thermal sensation data is that:

$$TSV_q=TSV_1\times a1+TSV_2\times a2+TSV_3\times a3+\ldots+TSV_j\times aj,$$

where $TSV_q$ represents the group thermal sensation data, $TSV_1$ represents the thermal sensation data of the target person numbered 1, a1 represents a thermal sensation weight of the target person numbered 1, $TSV_j$ represents the thermal sensation data of the target person numbered j, aj represents a thermal sensation weight of the target person numbered j, and j is a positive integer; and wherein a1+a2+ . . . +aj=1, and if there is no a special case, a1=a2= . . . =aj.

7. The multi-area artificial fog pipe network control method based on the YOLOv5 algorithm according to claim 1, wherein a calculation formula of the total flow of the fog-making water is that: $Q_{total}=X_{total}\times TSV_{qtotal}\times b+e$, where $Q_{total}$ represents the total flow of the fog-making water, $X_{total}$ represents the total number of the at least one target person, $TSV_{qtotal}$ represents the total group thermal sensation data, b represents a linear regression fitting coefficient, and e represents an intercept.

* * * * *